United States Patent [19]

Nowak

[11] Patent Number: 4,633,203

[45] Date of Patent: Dec. 30, 1986

[54] COMBINED MICROSTRIPLINE PHASE SHIFTER AND ELECTRIC FIELD PROBE

[75] Inventor: Michael E. Nowak, Schaumburg, Ill.

[73] Assignee: Motorola, Inc., Schaumburg, Ill.

[21] Appl. No.: 834,984

[22] Filed: Feb. 28, 1986

[51] Int. Cl.[4] ..... H01P 1/18; H01P 7/06; H01P 5/07

[52] U.S. Cl. ..... 333/161; 333/156; 333/230; 333/246; 333/248

[58] Field of Search ..... 333/156, 161, 246, 248, 333/227, 230–235, 157, 21 R, 24 R

[56] References Cited

U.S. PATENT DOCUMENTS

| | | | |
|---|---|---|---|
| 2,961,620 | 11/1960 | Sommers | 333/161 |
| 3,114,121 | 12/1963 | Jordan | 333/161 |
| 4,434,409 | 2/1984 | Green | 333/24.1 |

*Primary Examiner*—Marvin L. Nussbaum

*Attorney, Agent, or Firm*—Donald B. Southard; Thomas G. Berry

[57] ABSTRACT

An electric field probe is disclosed as having an arcual shaped transmission line which is mounted over a substrate having a corresponding arcual shaped transmission line deposited thereon. The two arcual shaped transmission members overlap such that the electric field energy sampled by the probe may be communicated to a monitoring circuit or the like. Rotating the probe, varies the portion of the arcual shaped members that overlap thereby adjusting the physical and electrical length of the transmission line. Accordingly, the phase of the field energy will shift as viewed from the output port.

6 Claims, 2 Drawing Figures

COMBINED MICROSTRIPLINE PHASE SHIFTER AND ELECTRIC FIELD PROBE

FIELD OF THE INVENTION

This invention relates generally to phase shifters and field probes and is more particularly directed to phase shifters and field probes finding application at microwave frequencies.

BACKGROUND OF THE INVENTION

Those skilled in the art will appreciate the wide utility of electrical field probes in microwave applications. Field probes are typically mounted on waveguides or on resonant cavities to sample a selected portion of the electrical field within these structures to provide a signal to a monitoring circuit or the like. Often, it is desirable to change the phase at which the sampled information arrives at such monitoring equipment. During development, some microwave designers may employ a phase shifter commonly referred to as a "coaxial trombone line". As is commonly known in the art, a coaxial trombone line is basically a "U" shaped structure which is expandable in a manner similar to that of a trombone slide. The sliding action effectively lengthens the propagation path of the sampled electric field energy thereby changing the phase as viewed from the monitoring equipment or other subsequent circuitry that may be employed.

Although satisfactory during the development stage, the coaxial trombone line is too bulky to provide practical use in modern-day microwave transceivers. Accordingly, some microwave designers have replicated the effect of a coaxial trombone line using microstrip technologies. Essentially, two parallel transmission lines are deposited on a substrate. A covering substrate having the "U" connection is placed over the parallel transmission lines in a slideable fashion to control the electrical length along which the sampled field energy must propagate.

However, this approach suffers two severe detriments. Firstly, the microstrip trombone line is difficult to manufacture since mechanical tolerances must be controlled in two dimensions (i.e., both x and y). Should the mechanical tolerance error result in a misalignment of the parallel transmission lines and the slideable plate, the sample field energy may be distorted due to the lossy effects caused by the misalignment. This results in measurement uncertainty and error. Secondly, the microstrip trombone line, though smaller than its coaxial counterpart, still requires a sizeable substrate to implement. Moreover, there must be room allocated to allow the slideable portion to move to control the phase shift. This design is contrary to the modern-day trend towards miniaturization of electronic communications equipment.

Accordingly, there is a need for a miniaturized phase shifter that is simple and inexpensive to build and avoids the detrimental measurement error of the prior art.

SUMMARY OF THE INVENTION

Accordingly, it is an object of this invention to provide a microwave phase shifter that avoids the detriments of the prior art.

It is a further object of the present invention to provide a microwave phase shifter combined with an electric field probe that is simple and inexpensive to manufacture.

It is yet another object of the present invention to provide a combined phase shifter and electric field probe that overcomes the detrimental measurement uncertainty of the prior art.

Accordingly, these and other objects are achieved in the present microstrip line phase shifter and electric field probe.

In practicing the invention, a probe having an arcual shaped transmission line is mounted over a substrate having a corresponding arcual shaped transmission line deposited thereon. The two arcual shaped transmission members overlap such that the electric field energy sampled by the probe may be communicated to a monitoring circuit or the like. Rotating the probe, changes the portion of the arcual shaped members that overlap thereby adjusting the physical and electrical length of the transmission line. Accordingly, the phase of the field energy will shift as viewed from the the output port.

BRIEF DESCRIPTION OF THE DRAWINGS

The features of the present invention which are believed to be novel are set forth with particularity in the appended claims. The invention, together with further objects and advantages thereof may be understood by reference to the following description, taken in conjunction with the accompanying drawings, and the several figures of which like referenced numerals identify like elements, and in which:

DETAILED DESCRIPTION OF THE PREFERRED EMBODIMENT

Figure 1:
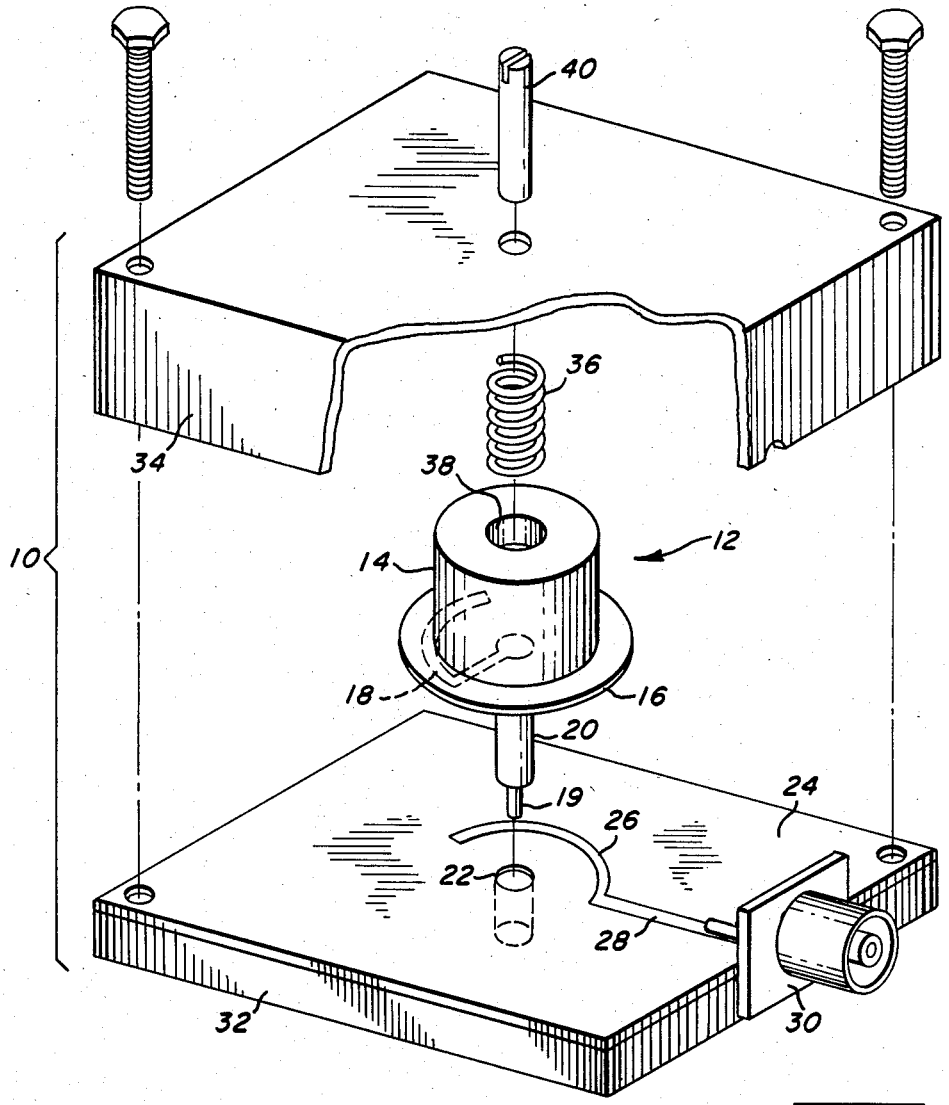
FIG. 1 is an exploded perspective view of the present invention.
Figure 2:
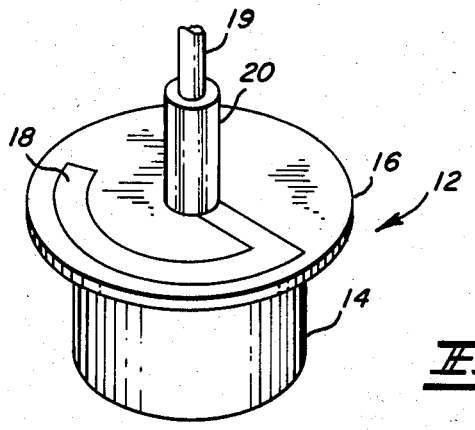
FIG. 2 is a view in perspective of the probe of FIG. 1.

In FIG. 1 there is shown the combined microstrip phase shifter and electric field probe 10 of the present invention. The probe 12 (see also FIG. 2) is comprised of a knob 14, a disc-shaped substrate 16 having deposited thereon an arcual shaped transmission line 18. Centrally positioned on the substrate 16 is a conductor 19, which couples to the transmission member 18. In operation, the conductor 19, which is partially covered by a cylindrically shaped dielectric 20, is positioned through a port 22 in the substrate 24. The cylindrically shaped dielectric 20 extends up to and ends flush with the inside wall of the cavity, waveguide or the like (not shown) to form a dielectrically loaded transmission line with the conductor 19 and the predetermined diameter of the port 22. The conductor 19 protrudes into a waveguide, resonant cavity or the like to sample the radio frequency (RF) electric field energy. The sampled energy travels through the dielectrically loaded transmission line formed by the conductor 19, the cylindrically shaped dielectric 20 and the port 22 and propagates along the arcual shaped member 18, a portion of which overlaps with a corresponding shaped member 26 deposited on the substrate 24. The energy may then be communicated along a length of transmission line 28 to an output port 30.

By rotating the probe 12 the arcual shaped members 18 and 26 will overlap more or less thereby changing both the physical and electrical length that the sampled energy must propagate to reach the output port 30, which is typically coupled to monitoring equipment or other such circuitry that may be employed in a particular implementation. The substrate 24 may be mounted directly on the waveguide or oscillator cavity, or alternately may be mounted on a carrier plate 32 constructed of brass or similar material.

A cover 34 may be placed over the substrate 24 and carrier 32 to properly house and electomagnetically shield the present invention. Of course, with the cover 34 in place the probe 12 cannot be rotated. Accordingly, in the preferred embodiment of the present invention, a tension applying means 36 (such as a spring or equivalent device), is disposed centrally along the knob 14 in a recessed portion 38. The spring 36 applies an effective amount of tension to the knob 14 to prevent inadvertent rotation, which results in an unwanted phase shift. A rod 40 is placed through the cover 34 and the spring 36 and is bonded to the knob 14 in the recessed area 38. This enables the probe 12 to be rotatably varied from the outside of the cover 34.

In the preferred embodiment of the present invention, the microstrip transmission line 28 and the arcual shaped members 18 and 26 are comprised of copper foil. Alternately, gold or other such material may be used. The substrate material 24 and 16 may be any suitable material such as teflon or the like and in the preferred embodiment the substrate 16 is at least twice as thick as the substrate 24 to reduce radiation loss. Alternately, if the knob 14 were to be constructed of a suitable material, the arcual shaped member 18 could be plated directly thereon eliminating the need for substrate 16.

Those skilled in the art will appreciate that the amount of phase shift along a transmission line is a function of the frequency of operation. Accordingly, the width and size of the arcual members (18 and 26) and length of transmission line (28) will vary depending upon the utilized frequency and the amount of phase shift required. The equations governing the geometry of micro-strip lines are known in the art and have been discussed by Bedair et al., in a paper entitled "Accurate formulas for computer-aided design of shielded microstrip circuits", IEE PROC., Vol. 127, Pt. H, No. 6, December 1980, which is hereby incorporated by reference. As is known, the desired operation of a phase shifter is to have a fixed real part and a variable imaginary part of the input impedance (i.e. a fixed magnitude and variable phase). Referring again to FIG. 1, the input impedance as viewed from the connector 30 is:

$$Z_{in} = \left[ \frac{Z_p + j\,Z_o \tan(\beta l)}{Z_o + j\,Z_p \tan(\beta l)} \right] Z_o$$

where:

$Z_o$ is the characteristic impedance $Z_p$ is the impedance of the probe l is the physical length of the line;

$\beta$ is the propagation constant;

Thus, the imaginary portions of $Z_{in}$ in equation 1 vary depending upon the physical length (l) of the transmission lie. Thus by rotatably varying the overlapping portion of the arcual shaped members 18 and 26, the length of the line is varied which thereby varies the phase.

In summary a combined microwave phase shifter and electric field probe is disclosed. By constructing the arcual shaped members 18 and 26 in radial symmetry to the central axis illustrated by the conductor 19, the mechanical tolerances are eliminated to only the radial dimension. This provides a simple and inexpensive structure that renders measurement uncertainty and error.

Although a particular embodiment of the invention has been described and shown, it should be understood that the invention is not limited thereto since many modifications may be made. It is therefore contemplated to cover by the present application any and all such modifications that may fall within the true spirit and scope of the basic underlying principles disclosed and claimed herein:

What is claimed is:

1. A combined probe and phase-shifting device for a waveguide or resonant cavity, comprising:

probe means for sampling a portion of an electric field from the waveguide or resonant cavity, including a first microstrip transmission member having a substantially arcual shape coupled to a conductor;

second microstrip transmission member constructed and arranged on a substrate and having a substantially arcual shape, said probe means and said substrate being constructed and arranged such that said first and second microstrip transmission members are positioned in radial symmetry to a central axis defined by said conductor and at least a portion of said transmission members overlap;

whereby the device operates to conduct said sampled electric field through said centrally positioned conductor and said probe means may be rotatably varied to increase or decrease the overlapping portion of said first and second microstrip transmission members, thereby changing the phase of the sampled electric field.

2. The device of claim 1, which further includes:

means for electromagnetically shielding the device;

means for rotating said probe means within said shielding means;

tension means, disposed between said shielding means and said probe means for maintaining an effective amount of tension upon said probe means.

3. The device of claim 1, wherein the probe means includes a substrate member upon which said first transmission member is deposited.

4. The device of claim 1, which further includes a third microstrip transmission member coupled to said second arcual transmission member, said third transmission member having a predetermined length to provide an effective amount of phase shift.

5. A combined probe and phase-shifting device for a waveguide or resonant cavity, comprising:

probe means for sampling a portion of an electric field from the waveguide or resonant cavity, including a first microstrip transmission member having a substantially arcual shape coupled to a conductor;

second microstrip transmission member constructed and arranged on a substrate and having a substantially arcual shape, said probe means and said substrate being constructed and arranged such that said first and second microstrip transmission members are positioned in radial symmetry to a central axis defined by said conductor and at least a portion of said transmission members overlap;

means for electromagnetically shielding the device;

tension means, disposed between said shielding means and said probe means for maintaining an effective amount of tension upon said probe means;

means for rotating said probe means within said shielding means;

whereby the device operates to conduct said sampled electric field through said centrally positioned conductor and said probe means may be rotatably varied to increase or decrease the overlapping portion of said first and second microstrip transmission members, thereby changing the phase of the sampled electric field.

6. A combined probe and phase-shifting device for a waveguide or resonant cavity, comprising:

probe means for sampling a portion of an electric field from the waveguide or resonant cavity, including a first substrate having a first microstrip transmission member deposited thereon, said first transmission member being coupled to a conductor and having a substantially arcual shape;

second microstrip transmission member constructed and arranged on a second substrate and having a substantially arcual shape, said probe means and said substrate being constructed and arranged such that said first and second microstrip transmission members are positioned in radial symmetry to a central axis defined by said conductor and at least a portion of said transmission members overlap;

means for electromagnetically shielding the device;

tension means, disposed between said shielding means and said probe means for maintaining an effective amount of tension upon said probe means;

means for rotating said probe means within said shielding means;

whereby the device operates to conduct said sampled electric field through said centrally positioned conductor and said probe means may be rotatably varied to increase or decrease the overlapping portion of said first and second microstrip transmission members, thereby changing the phase of the sampled electric field.

* * * * *